US009441619B2

(12) United States Patent
Ito et al.

(10) Patent No.: US 9,441,619 B2
(45) Date of Patent: Sep. 13, 2016

(54) RECIPROCATING COMPRESSOR

(71) Applicant: HITACHI AUTOMOTIVE SYSTEMS, LTD., Ibaraki (JP)

(72) Inventors: Tsutomu Ito, Sagamihara (JP); Teruaki Yamanaka, Ayase (JP)

(73) Assignee: HITACHI AUTOMOTIVE SYSTEMS, LTD., Ibaraki (JP)

( * ) Notice: Subject to any disclaimer, the term of this patent is extended or adjusted under 35 U.S.C. 154(b) by 216 days.

(21) Appl. No.: 14/208,317

(22) Filed: Mar. 13, 2014

(65) Prior Publication Data

US 2014/0294636 A1 Oct. 2, 2014

(30) Foreign Application Priority Data

Mar. 29, 2013 (JP) ..... 2013-074342

(51) Int. Cl.

| | |
|---|---|
| ***F04B 27/02*** | (2006.01) |
| ***F04B 25/00*** | (2006.01) |
| ***F04B 35/01*** | (2006.01) |
| ***F04B 53/00*** | (2006.01) |
| ***F04B 53/14*** | (2006.01) |
| *F04B 9/04* | (2006.01) |
| *F04B 27/04* | (2006.01) |
| *F04B 39/00* | (2006.01) |

(52) U.S. Cl.

CPC ..... *F04B 27/02* (2013.01); *F04B 25/005* (2013.01); *F04B 35/01* (2013.01); *F04B 39/0094* (2013.01); *F04B 53/006* (2013.01); *F04B 53/147* (2013.01); *F04B 9/045* (2013.01); *F04B 27/0409* (2013.01); *F04B 27/0414* (2013.01); *F04B 39/0005* (2013.01); *F04B 39/0022* (2013.01)

(58) Field of Classification Search

CPC .. F04B 25/005; F04B 27/02; F04B 39/0022; F04B 39/0094; F04B 53/006; F04B 53/144; F04B 53/147; F04B 53/22; F04B 1/0413; F04B 1/0417; F04B 9/04

See application file for complete search history.

(56) References Cited

U.S. PATENT DOCUMENTS

| | | | | |
|---|---|---|---|---|
| 2,449,930 A * | 9/1948 | Davey | F04B 27/053 | 417/569 |
| 4,494,286 A * | 1/1985 | Kaufman | F16C 9/04 | 123/197.4 |
| 4,546,670 A * | 10/1985 | Gaspardo | A01D 34/30 | 123/197.4 |

(Continued)

FOREIGN PATENT DOCUMENTS

| | | |
|---|---|---|
| JP | 2007-205207 | 8/2007 |
| JP | 2007205207 A * | 8/2007 |

*Primary Examiner* — Devon Kramer
*Assistant Examiner* — Joseph Herrmann
(74) *Attorney, Agent, or Firm* — Wenderoth, Lind & Ponack, L.L.P.

(57) ABSTRACT

A reciprocating compressor including a casing which has first and second cylinders, an electric motor which has a drive shaft mounted in the casing, first and second pistons fittingly inserted into the first and second cylinders respectively, so as to reciprocate therein, and first and second connecting rods attached to the first and second pistons, respectively, at ends thereof and which are situated in the crank chamber at the other ends thereof where first and second bearings are provided, respectively. A crank member is provided on the drive shaft within the crank chamber, and the crank member is fittingly inserted into the first bearing of the first connecting rod and the second bearing of the second connecting rod. The crank member has a positioning member which positions the first and second bearings with respect to an axial direction.

18 Claims, 5 Drawing Sheets

(56) References Cited

U.S. PATENT DOCUMENTS 4,642,839 A * 2/1987 Urban ..... D21G 3/005 101/157
5,515,769 A * 5/1996 Basinski ..... F04B 39/04 417/420
6,485,266 B2 * 11/2002 DeRuyter ..... F04B 39/066 417/201
8,128,382 B2 * 3/2012 Smits ..... F01B 7/04 417/415
8,388,317 B2 * 3/2013 Sung ..... F04B 27/0414 417/273
2011/0256001 A1 * 10/2011 Kobayashi ..... F04B 25/005 417/339
2012/0193845 A1 * 8/2012 Yamanaka ..... B60G 11/26 267/64.28

* cited by examiner

RECIPROCATING COMPRESSOR

TECHNICAL FIELD

The present invention relates to a reciprocating compressor which is preferably used to supply height controlling compressed air to or discharge it from an air suspension which is mounted in a vehicle such as a four-wheel motor vehicle.

BACKGROUND ART

In general, compressed air is supplied to or discharged from an air suspension which is mounted in a vehicle as a height controlling device from an onboard air compressor not only to suppress a change in the height of the vehicle (vehicle height) which occurs as the weight of a load, for example, changes but also to control the vehicle height appropriately so as to match it with the driver's preference or the like.

In addition, an onboard air compressor for supplying compressed air to an air suspension is such that a reciprocating compressor is driven by an electric motor so that air taken into the reciprocating compressor is compressed for supply to the air suspension.

In recent years, an improvement in response speed in controlling the vehicle height has been desired, and one of methods for improving the response speed, a method is adopted in which compressed air is accumulated in an air reservoir or tank. By adopting this method, it is possible to supply a required amount of compressed air to the air suspension from the air tank momentarily in controlling the vehicle height.

When the compressed air accumulated in the air tank is supplied to the air suspension, however, compressed air which is higher in pressure than that of compressed air that is used in the air suspension needs to be accumulated in the air tank. In conjunction with this, as such a reciprocating compressor, a reciprocating compressor is necessary which can compress compressed air to a high pressure.

A two-stage reciprocating compressor is said to be effective as the reciprocating compressor which can compress compressive air to the high pressure. This two-stage reciprocating compressor includes a casing which has a first cylinder and a second cylinder which are disposed so as to surround a crank chamber, an electric motor which is mounted on the casing and which has a rotating shaft, first and second pistons which are inserted in the first and second cylinders, respectively, so as to reciprocate therein, and first and second connecting rods which are attached to the first and second pistons, respectively, at ends thereof and which are situated in the crank chamber at the other ends thereof where a first bearing and a second bearing are provided, respectively. Additionally, the first and second connecting rods are attached to the rotating shaft of the electric motor via an eccentric member which is provided in inner circumferences of the first and second bearings (for example, refer to Japanese Unexamined Patent Publication No. 2007-205207).

SUMMARY OF INVENTION

In the reciprocating compressor described in Japanese Unexamined Patent Publication No. 2007-205207, the first and second bearings have to be large in diameter since the first and second bearings are mounted in the first and second connecting rods, respectively, via the eccentric member.

Further, the end portions of the first and second connecting rods which are situated to face the crank chamber also have to be large in diameter, leading to a problem that the configuration is disadvantageous from the viewpoints of weight and size.

In addition, although it is considered to reduce the size of the first and second bearings by using a crankshaft to eliminate the eccentric member, a complex construction has to be provided in order for the two bearings to be mounted on the single crankshaft, and further, a problem is also provided that the assembling properties are deteriorated.

The invention has been made with a view to solving the problems and an object thereof is to provide a reciprocating compressor which can realize a reduction in both size and cost with a simple construction.

With a view to achieving the object by solving the problems, according to an aspect of the invention, there is provided a reciprocating compressor including a casing which has a first cylinder and a second cylinder which are disposed so as to surround a crank chamber, a rotating shaft which is mounted rotatably in the casing, a driving device which is connected to one end side of the rotating shaft to rotationally drive the rotating shaft, first and second pistons which are fittingly inserted in the first and second cylinders, respectively, so as to reciprocate therein, and first and second connecting rods which are attached to the first and second pistons, respectively, at end portions thereof and which are situated in the crank chamber at the other ends thereof where a first bearing and a second bearing are provided, respectively, wherein a first shaft portion which is fittingly inserted into the first bearing of the first connecting rod is provided at the other end side of the rotating shaft, and a connecting member which is fittingly inserted into the second bearing of the second connecting rod and which fixes the second connecting rod in the direction of the rotating shaft is connected to a distal end portion of the first shaft portion.

According to the invention, it is possible to realize a reduction in both size and cost.

BRIEF DESCRIPTION OF DRAWINGS

FIG. 5 is a vertical sectional view of a compressing structure portion of a reciprocating compressor according to a second embodiment of the invention, as seen from a similar position to the position from which FIG. 2 is seen.

DESCRIPTION OF EMBODIMENTS

Hereinafter, a reciprocating compressor according to embodiments of the invention will be described in detail by reference to the accompanying drawings as being applied to a two-stage reciprocating compressor which is mounted in a vehicle equipped with an air suspension system.

Figure 1:
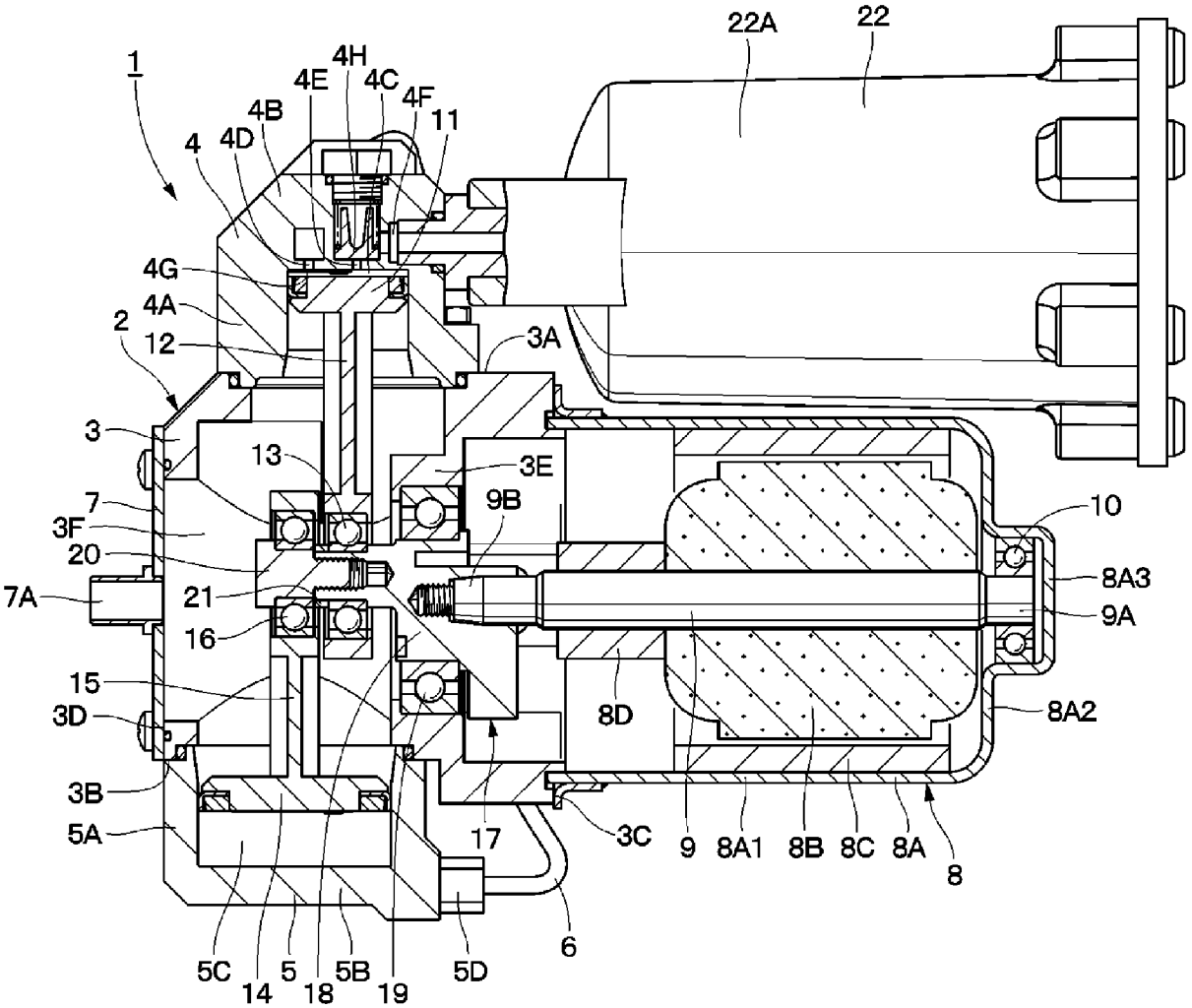
FIG. 1 is a vertical sectional view showing a reciprocating compressor according to a first embodiment of the invention.

Firstly, FIGS. 1 to 4 show a first embodiment of the invention. In FIG. 1, an onboard reciprocating air compressor 1 includes a casing 2, which will be described later, an electric motor 8, pistons 11, 14, connecting rods 12, 15, a crank member 17, and an air drier 22.

The casing 2 of the reciprocating air compressor 1 includes a box-shaped crankcase 3, a first cylinder 4 which is mounted on the crankcase 3, and a second cylinder 5 which is mounted on the crankcase 3. Here, the cylinders 4, 5 are disposed in a position where the cylinders 4, 5 surround a crank chamber 3F of the crankcase 3, which will be described later, that is, for example, in a position where the cylinders 4, 5 hold the crank chamber 3F therebetween.

Figure 2:
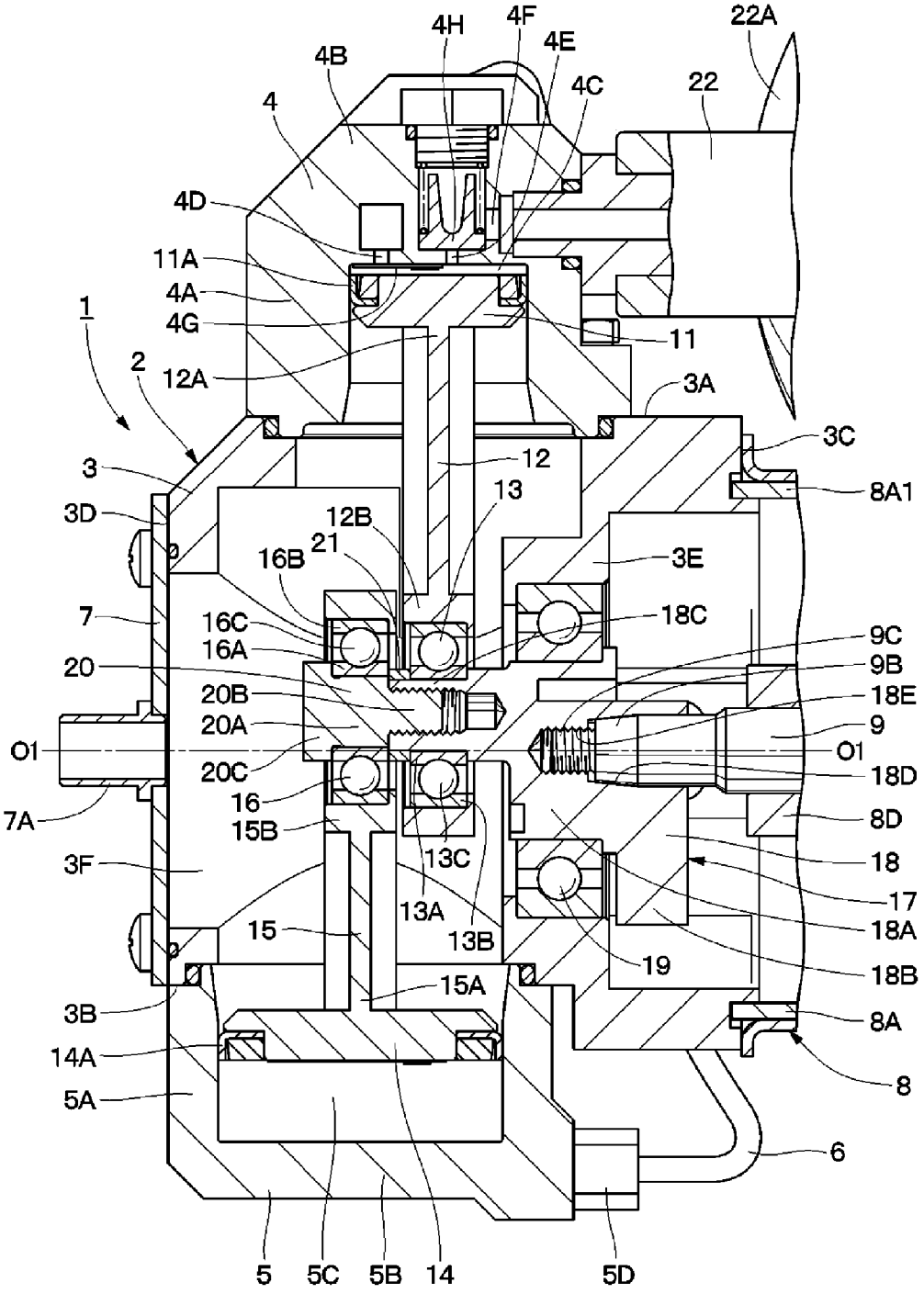
FIG. 2 is a vertical sectional view showing a compressing structure portion in FIG. 1 in an enlarged fashion.
Figure 3:
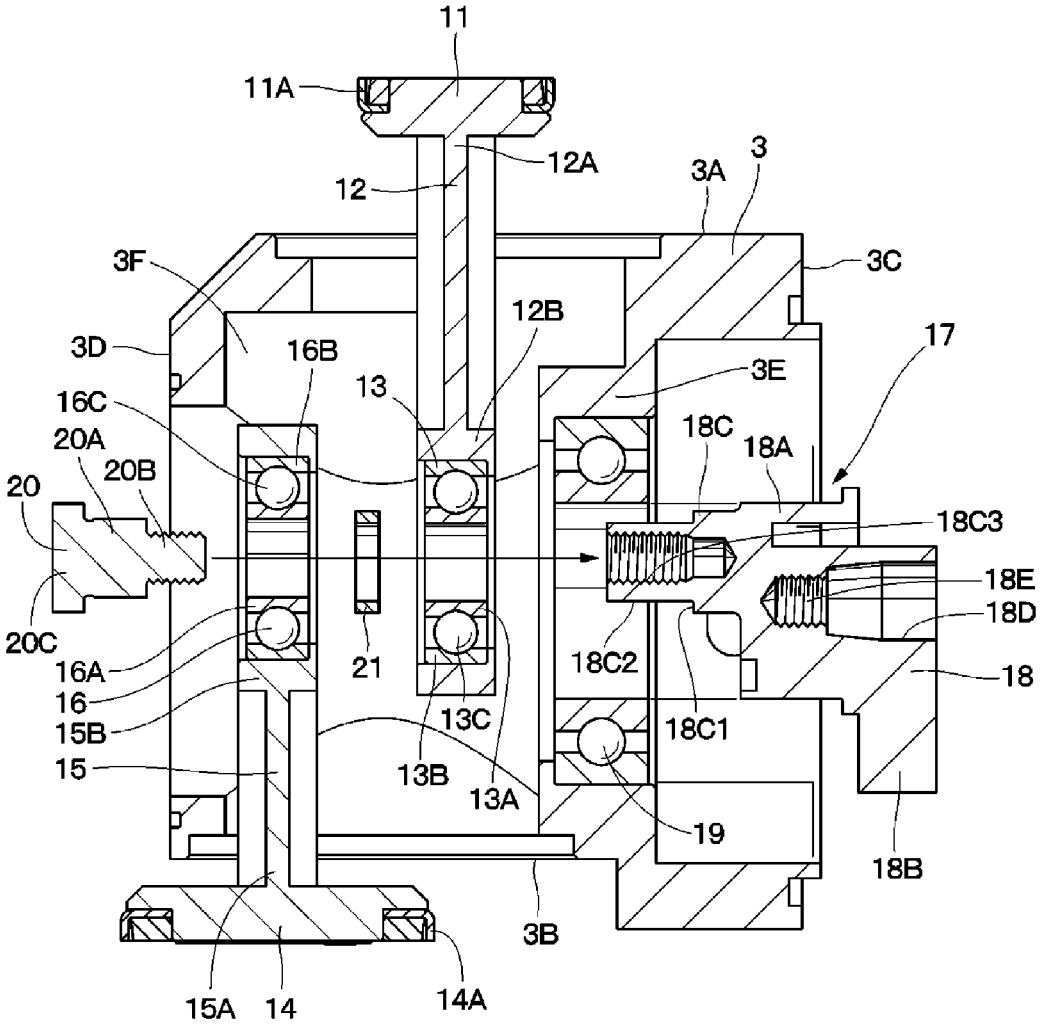
FIG. 3 is an exploded vertical sectional view showing a crankcase, pistons, connecting rods, a spacer and a crank member in an exploded fashion.

As shown in FIGS. 2, 3, the crankcase 3 is made up of a hollow structure member which has a first cylinder mounting surface 3A and a second cylinder mounting surface 3B which are situated in positions where the surfaces are opposite to each other, and a lateral surface of the crankcase 3 which is situated between the first and second cylinder mounting surfaces 3A, 3B constitutes a motor mounting surface 3C. In addition, a lateral surface of the crankcase 3 which is situated between the first and second cylinder mounting surfaces 3A, 3B and is situated opposite to the motor mounting surface 3C constitutes a lid member mounting surface 3D. A lid member 7, which will be described later, is mounted on this lid member mounting surface 3D so as to close an opening for assembling work. Further, an annular bearing supporting portion 3E is formed in the crankcase 3 by contracting diametrically a portion which lies inwards from the motor mounting surface 3C. Additionally, a crank bearing 19, which will be described later, is supported in this bearing supporting portion 3E.

In the crankcase 3, a space surrounded by the first cylinder mounting surface 3A, the second cylinder mounting surface 3B, the motor mounting surface 3C and the lid member mounting surface 3D constitutes the crank chamber 3F. The connecting rods 12, 15 and the crank member 17, which will be described later, are disposed within the crank chamber 3 in a connected state.

The first cylinder 4 is mounted on the first cylinder mounting surface 3A of the crankcase 3. The first cylinder 4 constitutes a high-pressure cylinder which takes in air which is compressed to an intermediate pressure to discharge compressed air of high pressure. The first cylinder 4 has a cylindrical cylinder main body 4A and a cylinder heat 4B. The cylinder main body 4A is mounted on the first cylinder mounting surface 3A at a proximal end side thereof. The cylinder head 4B is provided so as to close a distal end side of the cylinder main body 4A. Here, a compression chamber 4C is defined between the cylinder head 4B and a first piston 11, which will be described later, in the cylinder main body 4A.

A suction port 4D and a discharge port 4E are provided in the cylinder head 4B in such a way as to communicate with the compression chamber 4C. The suction port 4D is connected with a discharge port 5D which is provided in a cylinder head 5B of the second cylinder 5, which will be described later, via a connecting pipe line 6. On the other hand, the discharge port 4E is connected with a drier mounting port 4F where the air drier 22, which will be described later, is mounted. Further, a suction valve 4G and a discharge valve 4H are provided in the cylinder head 4B. The suction valve 4G prevents a reversal of compressed air which is taken in from the suction port 4D, and the discharge valve 4H prevents a reversal of compressed air which is discharged from the discharge port 4E towards the drier mounting port 4F.

The second cylinder 5 is mounted on the second cylinder mounting surface 3B of the crankcase 3. The first cylinder 4 and the second cylinder 5 are disposed opposite to each other across the crank chamber 3F. The second cylinder 5 constitutes a low-pressure cylinder which takes in air of low pressure (atmospheric pressure) to discharge compressed air of intermediate pressure. The second cylinder 5 has a cylindrical cylinder main body 5A and a cylinder heat 5B. The cylinder main body 5A is mounted on the second cylinder mounting surface 3B at a proximal end side thereof. The cylinder head 5B is provided so as to close a distal end side of the cylinder main body 5A. A bore diameter dimension of the cylinder main body 5A is set to a dimension which is larger than a bore diameter dimension of the cylinder main body 4A of the high-pressure cylinder 4. Here, a compression chamber 5C is defined between the cylinder head 5B and a second piston 14, which will be described later, in the cylinder main body 5A.

The discharge port 5D is provided in the cylinder head 5B in such a way as to communicate with the compression chamber 5C, and the discharge port 5D is connected to the suction port 4D which is provided in the cylinder head 4B of the first cylinder 4 via the connecting pipe line 6. It is noted that a discharge valve (not shown) is provided in the discharge port 5D so as to prevent a reversal of compressed air which is discharged towards the connecting pipe line 6.

The lid member 7 is mounted on the lid member mounting surface 3D so as to close the opening in the lid member mounting surface 3D of the crankcase 3. An intake port 7A is provided in the lid member 7 so as to take in air in the crank chamber 3F of the crankcase 3, and an intake air filter (not shown) is mounted in the intake port 7A so as to remove dust in the air.

As shown in FIG. 1, the electric motor 8 is mounted on the casing 2 as a driving device and constitutes a driving device of the reciprocating air compressor 1. This electric motor 8 includes a drive shaft 9, which will be described later and is made up of a motor case 8A, a rotor 8B, a stator 8C, a commutator 8D and the like. The drive shaft 9 of the electric motor 8 has a general shape and is formed of a general material, whereby the electric motor 8 can be fabricated inexpensively.

The motor case 8A, which constitutes an outer shell of the electric motor 8, accommodates therein the drive shaft 9, the rotor 8B, the stator 8C and the like and is mounted on the motor mounting surface 3C of the crankcase 3. This motor case 8A is made up of a cylindrical portion 8A1 and a bottom portion 8A2, and a small-diameter, bottomed, cylindrical bearing accommodating portion 8A3 is provided in a center of the bottom portion 8A2. Here, as shown in FIG. 2, the motor case 8A is disposed about an axis O1-O1 as its center line, and the axis O1-O1 also constitutes axes of a bearing supporting portion 3E of the crankcase 3 and the drive shaft 9.

The rotor 8B, which makes up the electric motor 8, is formed by coils which are disposed within the motor case 8A and are mounted around an outer circumference of the drive shaft 9. The stator 8C is formed by permanent magnets which are mounted on an inner surface of the cylindrical portion 8A1 of the motor case 8A so as to face an outer circumferential side of the rotor 8B with a gap defined therebetween. Further, the commutator 8D is made up of a cylindrical member which is situated at the other end side of the rotor 8B and is provided around an circumference of the drive shaft 9. Additionally, a plurality of brushes (neither of which is shown) are disposed around a circumference of the commutator 8D so as to be brought into sliding contact with the commutator 8D for feeding.

As shown in FIG. 1, the drive shaft 9 which is provided within the motor case 8A is supported rotatably at one longitudinal end 9A thereof by the bearing accommodating portion 8A3 of the motor case 8A via a rotating shaft bearing 10. Additionally, the other longitudinal end 9B of the drive shaft 9 is supported rotatably by the bearing supporting portion 3E via a crank main body 18, which will be described later, and the crank bearing 19 within the crank chamber 3F of the crankcase 3. By adopting this configuration, the drive shaft 9 is driven to rotate about the axis O1-O1 which passes through the centers of the bearing supporting portion 3E of the crankcase 3 and the motor case 8A with both the longitudinal ends thereof supported.

Further, an external thread portion 9C is provided at the other end 9B of the drive shaft 9 so as to project coaxially therefrom. This external thread portion 9 is screwed into an internal thread hole 18E formed in a rotating shaft side of the crank main body 18, whereby the crank member 17 can be fixed to the other end 9B side of the drive shaft 9 so as to rotate together therewith.

Here, the drive shaft 9 functions to transmit the rotating force of the electric motor 8 to the crank member 17 and is subjected to almost no radial load which is produced when the pistons 11, 14, which will be described later, reciprocate. This obviates the necessity of enhancing the strength of the drive shaft 9 by increasing a diametrical dimension thereof or using an expansive material. Namely, the drive shaft 9 can be formed almost in the same way as a shaft member which is mounted on a general electric motor.

The first piston 11 is fittingly inserted in the first cylinder 4 so as to reciprocate (slide) therein. This first piston 11 functions to recompress air of intermediate pressure which is supplied from the second cylinder 5, which constitutes the low-pressure cylinder, within the compression chamber 4C of the first cylinder 4. The first piston 11 is configured as an oscillating piston (a rocking piston). The first piston 11 is made up of a circular disc member which has a diametric dimension which is slightly smaller than a bore diameter dimension of the cylinder main body 4A. A lip seal 11A is mounted on a circumference of the first piston 11.

This lip seal 11A surrounds an outer circumferential side of the first piston 11 to thereby establish a gastight seal between an outer circumferential surface of the piston 11 and an inner circumferential surface of the cylinder main body 4A of the first cylinder 4, that is, the lip seal 11A seals up the compression chamber 4C in a gastight fashion. In addition, when a side of the first piston 11 where compression work is performed (a side which faces the compression chamber 4C) is referred to as a front surface, one end 12A of the first connecting rod 12, which will be described later, is attached integrally to a central portion on an opposite or back surface of the piston 11.

The first connecting rod 12 functions to connect the first piston 11 to the crank member 17, which will be described later. A longitudinal end 12A of the first connecting rod 12 is attached integrally to the central portion on the back surface of the first piston. On the other hand, the other end of the connecting rod 12 is situated within in the crank chamber 3F of the crankcase 3 and constitutes a cylindrical bearing supporting portion 12B, and a first bearing 13 is fittingly inserted into the bearing supporting portion 12B. This first bearing 13 is mounted on an eccentric shaft portion 18C of the crank main body 18 which make up the crank member 17, which will be described later.

Here, the first bearing 13 is configured as a ball bearing which is made up of an inner ring 13A, an outer ring 13B and a plurality of rolling element 13C. In the first bearing 13, the inner ring 13A is mounted on the eccentric shaft portion 18C of the crank main body 18, while the outer ring 13B is mounted in the bearing supporting portion 12B in the connecting rod 12. As this occurs, the first bearing 13 is disposed within the bearing supporting portion 12B so as not to be dislocated therefrom (so as to be positioned therein) through press fitting or by means of a device such as a snap ring or the like.

On the other hand, the second piston 14 is fittingly inserted in the second cylinder 5 so as to reciprocate (slide) therein. This second piston 14 functions to take in outside air (atmosphere) to compress it within the compression chamber 5C. As with the first piston 11, the second piston 14 is configured as an oscillating piston (a rocking piston). The second piston 14 is made up of a circular disc member which has a diametric dimension which is slightly smaller than a bore diameter dimension of the cylinder main body 5A. A lip seal 14A is mounted on a circumference of the second piston 14. The second piston 14 is formed as the circular disc member which has the diametric dimension larger than that of the first piston 11.

In addition, a suction port and a suction valve (neither of which is shown) are provided in the second piston 14. Air within the crankcase 3 is introduced into the compression chamber 5C through this suction port, and the suction valve prevents a reversal of air which passes through the suction port. Further, when a side of the piston 14 which faces the compression chamber 5C is referred to as a front surface, one end 15A of the second connecting rod 15, which will be described later, is attached integrally to a central portion on an opposite or back surface of the second piston 14.

The second connecting portion 15 functions to connect the second piston 14 to the crank member 17, which will be described later. The longitudinal end 15A of the second connecting rod 15 is attached integrally to the central portion on the back surface of the second piston 14. On the other hand, the other end of the connecting rod 15 is situated within the crank chamber 3F of the crankcase 3 to constitute a cylindrical bearing supporting portion 15B, and a second bearing 16 is fitted in this bearing supporting portion 15B. This second bearing 16 is mounted on a shaft portion 20A of a positioning member 20 which makes up the crank member 17, which will be described later.

Here, as with the first bearing 13 described above, the second bearing 16 is configured as a ball bearing which is made up of an inner ring 16A, an outer ring 16B and a plurality of rolling elements 16C. In the second bearing 16, the inner ring 16A is mounted on the shaft portion 20A of the positioning member 20, and the outer ring 16B is mounted in the bearing supporting portion 15B of the second connecting rod 15. As this occurs, the second bearing 16 is disposed within the bearing supporting portion 15B so as not to be dislocated therefrom (so as to be positioned therein) through press fitting or by means of a device such as a snap ring or the like.

The crank member 17 is situated at the other end 9B side of the drive shaft 9 which constitutes the electric motor 8, that is, within the crank chamber 3F of the crankcase 3 and is provided as a separate member from the drive shaft 9. The first bearing 13 in the first connecting rod 12 is fitted on the crank member 17, and the second bearing 16 in the second connecting rod 15 is also fitted on the crank member 17. Further, the crank member 17 includes the positioning member 20 which positions the first bearing 13 and the second bearing 16 in the direction of the axis. Namely, the crank member 17 of the first embodiment is made up of the crank main body 18 and the positioning member 20.

Figure 4:
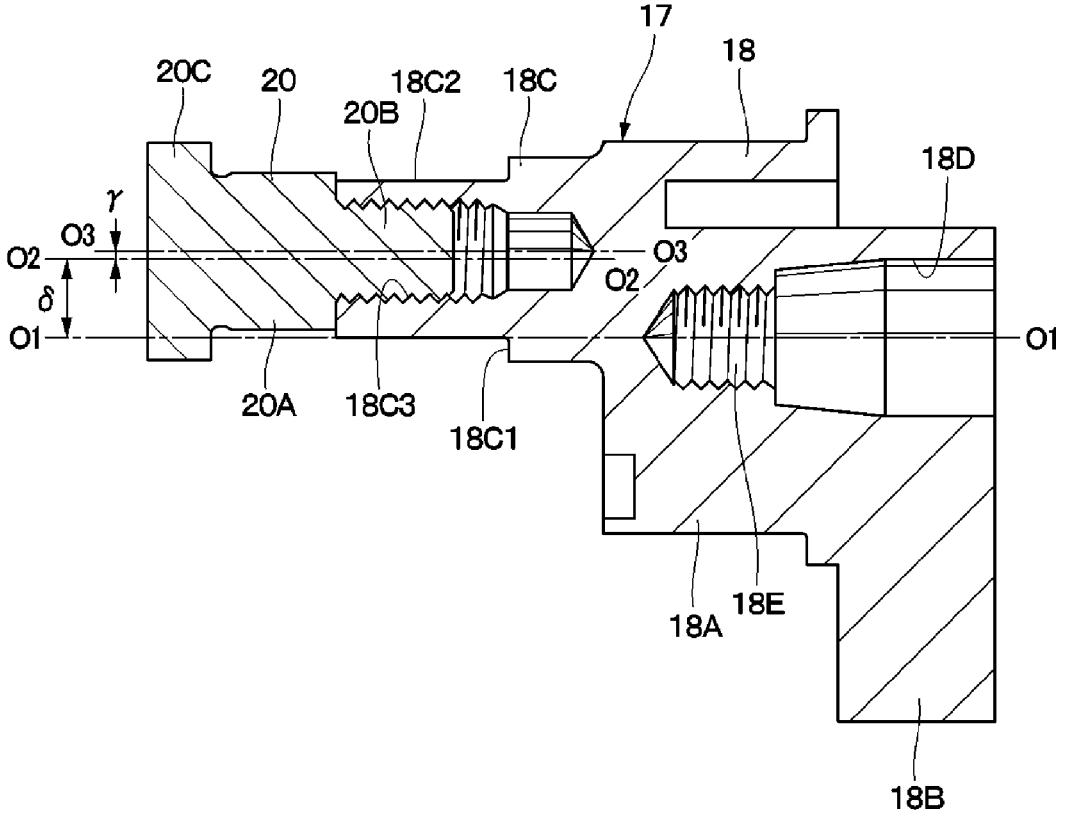
FIG. 4 is an enlarged vertical sectional view of the crank member with a crank main body and a positioning member assembled together.

The crank main body 18, which makes up the crank member 17, includes, as shown in FIGS. 3, 4, a rotating shaft portion 18A, a weight portion 18B and the eccentric shaft portion 18C. The rotating shaft portion 18A is situated in an intermediate position in the direction of the axis and has a short cylindrical shape. The weight portion 18B extends radially outwards from one side of the rotating shaft portion 18A to keep balance in weight when the rotating shaft portion 18A rotates. The eccentric shaft portion 18C is provided on the other end face of the rotating shaft portion 18A so as to project vertically (in parallel to the axis O1-O1) therefrom. This crank main body 18 constitutes a rotating shaft of the invention, and the eccentric shaft portion 18C constitutes a first shaft portion of the embodiment.

The rotating shaft portion 18A is mounted rotatably in the bearing supporting portion 3E of the crankcase 3 via the crank bearing 19 to thereby rotate coaxially with the drive shaft 9, that is, about the axis O1-O1. On the other hand, the eccentric shaft portion 18C is disposed on an opposite side to the side where the weight portion 18B is provided across the axis O1-O1 in such a state that the eccentric shaft portion 18C projects from the bearing supporting portion 3E. Specifically, as shown in FIG. 4, an axis O2-O2 which constitutes a center line of the eccentric shaft portion 18C is disposed in a position which deviates by a deviation amount δ from the axis O1-O1 of the rotating shaft portion 18A.

The eccentric shaft portion 18C has a supporting shaft portion 18C2. This supporting shaft portion 18C2 is reduced in diameter at a riser portion 18C1 which is situated at an axial end thereof and extends therefrom towards the other end side thereof. The first bearing 13 in the first connecting rod 12 is fitted on this supporting shaft portion 18C2 so as to be mounted thereon rotatably. By adopting this configuration, the first piston 11 is allowed to reciprocate within the first cylinder 4 over a distance equal to twice the deviation amount δ, that is, in a stroke of 2δ.

Further, a positioning member side internal thread hole 18C3 is formed in the eccentric shaft portion 18C so as to be opened to the other end face of the supporting shaft portion 18C2. An axis O3-O3 which constitutes a center line of the positioning member side internal thread hole 18C3 is disposed in a position which deviates by a deviation amount γ from the axis O2-O2 of the eccentric shaft portion 18C towards an opposite side to the side where the weight portion 18B is provided. By adopting this configuration, the axis O3-O3 of the internal thread hole 18C3 is disposed in a position which deviates by an amount δ+γ which results from the addition of the deviation amount γ to the deviation amount δ from the axis O1-O1 of the rotating shaft portion 18A.

On the other hand, a rotating shaft side internal thread hole 18E is provided about the axis (the axis O1-O1) of the eccentric shaft portion 18A in a deep portion in a positioning hole 18D which is opened to one end side. The other longitudinal end 9B of the drive shaft 9 is fittingly inserted into the positioning hole 18D in a coaxial fashion, and the external thread portion 9C of the drive shaft 9 is screwed into the rotating shaft side internal thread hole 18E. By adopting this configuration, the crank main body 18 can rotate about the axis O1-O1 together with the drive shaft 9.

The positioning member 20, which functions as a connecting member of the invention, is disposed in the crank chamber 3F of the crankcase 3 and makes up the crank member 17 together with the crank main body 18. This positioning member 20 positions the first bearing 13 and the second bearing 16 in the axial direction and disposes the second bearing 16 on the axis O3-O3 which is different from the axis O2-O2 of the eccentric shaft portion 18C of the crank main body 18. The positioning member 20 is attached to the eccentric shaft portion 18C of the crank main body 18 in such a state that the positioning member 20 is inserted through the second bearing 16 which is provided on the second connecting member 15.

To be specific, the positioning member 20 includes a shaft portion 20A which is inserted through the second bearing 16, an external thread portion 20B which projects from one end portion of the shaft portion 20A, and a hexagonal head portion 20C which is formed by expanding diametrically the other end portion of the shaft portion 20A. In the positioning member 20, the shaft portion 20A can be disposed in a position which is contiguous with the supporting shaft portion 18C2 of the eccentric shaft portion 18C by the external thread portion 20B being securely screwed into the positioning member side internal thread portion 18C3 which is provided in the eccentric shaft portion 18C of the crank main body 18.

As this occurs, the positioning member 20 holds the respective inner rings 13A, 16A of the first and second bearings 13, 16 and a spacer 21, which will be described later, between the head portion 20C thereof and the riser portion 18C1 of the eccentric shaft portion 18C so as to position them in the axial direction while fixing them so that the inner rings and the spacer are not dislocated therefrom.

On the other hand, the internal thread portion 18C3 of the eccentric shaft portion 18C is disposed so that the axis O3-O3 thereof deviates by the deviation amount γ from the axis O2-O2 of the eccentric shaft portion 18C towards the opposite side to the side where the weight portion 18B is provided. It thus follows from this fact that the shaft portion 20A of the positioning member 20 which is securely screwed in the internal thread portion 18C3 is also disposed about the axis O3-O3.

Here, in the two-stage reciprocating air compressor 1, the diametrical dimensions of the second cylinder 5, which constitutes the low-pressure side cylinder, and the second piston 14 are set larger than the diametrical dimensions of the first cylinder 4, which constitutes the high-pressure side cylinder, and the first piston 11. Consequently, for example, when the first and second pistons 11, 14 are caused to reciprocate over the same stroke dimension, since the compression ratio differs between the high-pressure side and the low-pressure side, power necessary to rotate the drive shaft 9 of the electric motor 8 differs according to the rotating position (the circumferential position) of the drive shaft 9 between when air inside the compression chamber 4C of the first cylinder 4 is compressed and when air inside the compression chamber 5C of the second cylinder 5 is compressed. This increases the load when the drive shaft 9 is rotated, resulting in the necessity of a large (high-output) power source.

In contrast to what has been described above, in the first embodiment, the axis O3-O3 of the shaft portion 20A of the positioning member 20 is disposed so as to deviate by the deviation amount γ from the axis O2-O2 of the eccentric shaft portion 18C. Consequently, as its stroke amount, the second piston 14 can take a stroke amount 2(δ+γ) which is larger by an amount 2γ than the stroke amount 2δ of the first piston 11, and this enables the compression ratio to be equal between the high-pressure side and the low-pressure side. This keeps good rotating balance of the drive shaft 9 to thereby reduce the load, whereby the drive shaft 9 can be rotated even with small power. Namely, it is possible to realize a reduction in size, weight and fabrication cost of the electric motor 8 that constitutes the drive or power source of the reciprocating air compressor 1.

The spacer 21 is formed as an annular member which fits on an outer circumferential side of the eccentric shaft portion 18C of the crank main body 18. This spacer 21 functions to ensure a gap between the first bearing 13 and the second bearing 16 so as to prevent the interference of the first connecting rod 12 with the second connecting rod 15.

The air drier 22 (refer to FIG. 1) is attached to the first cylinder 4, and includes a drier case 22A and a water adsorbent (not shown). The drier case 22A is made up of a hollow closed container. The water adsorbent is a drying agent such as silica gel or the like which is accommodated in the driver case 22. The drier case 22A of the air drier 22 is attached to a drier attaching port 4F of the first cylinder 4. Additionally, the air drier 22 is connected to an air reservoir or tank which supplies compressed air to a plurality of air suspensions (both the air tank and the air suspensions are not shown) so as to supply or discharge dry compressed air towards the air tank.

The two-stage reciprocating air compressor 1 according to the first embodiment is configured as has been described heretofore, and an example of an assembling procedure of this reciprocating air compressor 1 will be described below.

The rotating shaft portion 18A of the crank main body 18 is fittingly inserted in the crank bearing 19 which is mounted in the bearing supporting portion 3E of the crankcase 3. In this state, the bearing supporting portion 12B of the first connecting rod 12 is inserted into the crank chamber 3F of the crankcase 3 from the first cylinder mounting surface 3A, so that the supporting shaft portion 18C2 of the eccentric shaft portion 18C is inserted into the inner ring 13A of the first bearing 13.

Next, the spacer 21 is disposed at a distal end of the supporting shaft portion 18C2. Then, the bearing supporting portion 15B of the second connecting rod 15 is inserted into the crank chamber 3F of the crankcase 3 from the second cylinder mounting surface 3B, so that the shaft portion 20A of the positioning member 20 is inserted into the inner ring 16A of the second bearing 16. Following this, the external thread portion 20B of the positioning member 20 is screwed into the positioning member side internal thread hole 18C3 which is provided in the eccentric shaft portion 18C of the crank main body 18. Then, a tool (not shown) is brought into engagement with the head portion 20C so as to tighten the positioning member 20. By doing so, the respective inner rings 13A, 16A of the first and second bearings 13, 16 and the spacer 21 are sandwiched between the head portion 20C of the positioning member 20 and the riser portion 18C1 of the eccentric shaft portion 18C, whereby the first and second bearings 13, 16 and the spacer 21 can be positioned in the axial direction. By performing the series of operations, the crank member 17 and the connecting rods 12, 15 (the pistons 11, 14) can be assembled in the crankcase 3.

When the crank member 17 and the first and second connecting rods 12, 15 are assembled in the crankcase 3, then, the first cylinder 4 is bolted down to the first cylinder mounting surface 3A of the crankcase 3. Additionally, the second cylinder 5 is bolted down to the second cylinder mounting surface 3B, and further, the lid member 7 is bolted down to the lid member mounting surface 3D. Next, the external thread portion 9C of the drive shaft 9 of the electric motor 8 is screwed into the rotating shaft side internal thread hole 18E in the crank main body 18, and the motor case 8A is bolted down to the motor mounting surface 3C of the crankcase 3. Further, the air drier 22 is attached to the drier attaching port 4F of the first cylinder 4. Thus, the reciprocating air compressor 1 can be built up.

Next, a compressing operation of the two-stage reciprocating air compressor 1 which is built up in the way described above will be described below.

When the reciprocating air compressor 1 is operated to compress air, the drive shaft 9 of the electric motor 8 is driven to rotate, whereby the crank member 17 is driven to rotate about the axis O1-O1 together with the drive shaft 9. By doing so, the second piston 14 reciprocates within the second cylinder 5, whereby outside air is taken into the compression chamber 5C via the intake port 7A in the lid member 7, the crank chamber 3F of the crankcase 3 and the suction port of the second piston 14. Then, the air so taken in is compressed by the second piston 14 to be discharged from the compression chamber 5C. On the other hand, the first piston 11 reciprocates within the first cylinder 4, whereby compressed air of intermediate pressure which is supplied from the second cylinder 5 by way of the connecting pipe line 6 is taken into the compression chamber 4C from the suction port 4D to be compressed therein. Then, the compressed air of intermediate pressure is compressed further to be compressed air of high pressure, and the resulting compressed air of high pressure is discharged from the discharge port 4E. The compressed air which is discharged from the discharge port 4*e* passes through the air drier 22 and is then stored in the air tank as clean and dry compressed air.

Here, in the first embodiment, the axis O3-O3 of the shaft portion 20A of the positioning member 20 is disposed so as to deviate by the deviation amount $\gamma$ from the axis O2-O2 of the eccentric shaft portion 18C of the crank main body 18. Consequently, the stroke amount of the second piston 14 which is connected to the positioning member 20 can be larger by the amount $2\gamma$ than the stroke amount $2\delta$ of the first piston 11 which is connected to the eccentric shaft portion 18C. This stroke amount $2\gamma$ is such an amount that enables the compression ratio to be equal between the high-pressure side and the low-pressure side when the high-pressure side first piston 11 and the low-pressure side second piston 14 whose diametric dimensions differ from each other reciprocate. By adopting this configuration, a variation in load when the drive shaft 9 is driven to rotate can be suppressed to a small level so that the drive shaft 9 can be kept rotating in good balance, whereby the drive shaft 9 is allowed to keep rotating smoothly even though only the small power is supplied from the electric motor 8.

Thus, according to the first embodiment, the crank member 17 is provided at the other longitudinal end 9B side of the drive shaft 9 of the electric motor 8. This crank member 17 is positioned within the crank chamber 3F of the crankcase 3 and is made up of the separate member from the drive shaft 9. The crank member 17 is fittingly inserted into the first bearing 13 of the first connecting rod 12 and the second bearing 16 of the second connecting rod 15. In addition to this, the crank member 17 includes the positioning member 20 which positions the first bearing 13 and the second bearing 16 in the axial direction.

Consequently, the drive shaft 9 is configured as a separate member from the crank member 17, and therefore, almost no load is applied to the drive shaft 9 when the first and second pistons 11, 14 reciprocate. Because of this, since the drive shaft 9 only has to function to transmit the rotating force of the electric motor 8, no large diametric dimension has to be given to the drive shaft 9, and no expensive strong material has to be used for the drive shaft 9. As a result of this, it is possible to realize a reduction in size and fabrication cost of the electric motor 8.

Here, in the first embodiment, the axis O3-O3 of the shaft portion 20A of the positioning member 20 is disposed so as to deviate by the deviation amount γ from the axis O2-O2 of the eccentric shaft portion 18C of the crank main body 18. Consequently, the stroke amount of the second piston 14 when it reciprocates can be larger by the amount 2γ than the stroke amount 2δ of the first piston 11 when it reciprocates. By adopting this configuration, the compression ratio can be equal between the high-pressure side first piston 11 and the low-pressure side second piston 14. As a result of this, the drive shaft 9 can be kept rotating in good balance, whereby the drive shaft 9 can be rotated even with small power. That is, it is possible to realize a reduction in size, weight and fabrication cost of the electric motor 8 which constitutes the power source of the reciprocating air compressor 1.

The crank member 17 is made up of the crank main body 18 and the positioning member 20. The crank main body 18 has the eccentric shaft portion 18C which is fittingly inserted into the first bearing 13 of the first connecting rod 12. The positioning member 20 is fittingly inserted into the second bearing 16 of the second connecting rod 15 and is also attached to the eccentric shaft portion 18C of the crank main body 18. Consequently, the external thread portion 20B of the positioning member 20 is screwed into the positioning member side internal thread hole 18C3 in the eccentric shaft portion 18C with the first bearing 13 of the first connecting rod 12 assembled to the eccentric shaft portion 18C of the crank main body 18 and the second bearing 16 of the second connecting rod 15 assembled to the shaft portion 20A of the positioning member 20. By doing so, the respective bearings 13, 16 of the first and second connecting rods 12, 15 can easily be mounted while being positioned in the axial direction by the crank member 17.

In addition, the positioning member 20 is fixed to the eccentric shaft portion 18C of the crank main body 18 with the center line (the axis O2-O2) of the eccentric shaft portion 18C caused to deviate by the amount γ from the center line (the axis O3-O3) of the positioning member 20. Consequently, the stroke amount 2δ of the high-pressure side first piston 11 and the stroke amount 2(δ+γ) of the low-pressure side second piston 14 can be made to differ from each other, whereby the compression ratio on the high-pressure side can be matched with the compression ratio of the low-pressure side only by mounting the positioning member 20 in the eccentric shaft portion 18C. Moreover, by making up the crank member 17 of the two members such as the crank main body 18 and the positioning member 20, the center line (the axis O2-O2) of the eccentric shaft portion 18C and the center line (the axis O3-O3) of the positioning member 20 can be disposed so as to deviate from each other. Additionally, it is also possible to vary γ easily only by changing the position of the positioning member side internal thread portion 18C3 of the eccentric shaft portion 18C.

On the other hand, the second cylinder 5 is configured as the low-pressure cylinder which takes in air of low pressure to compress it into compressed air of intermediate pressure and which discharges the resulting compressed air of high temperature. The first cylinder 4 is configured as the high pressure cylinder which takes in the compressed air of intermediate pressure to compress it into compressed air of high pressure and which discharges the resulting compressed air of high pressure. By adopting this configuration, the reciprocating air compressor 1 can supply the compressed air whose pressure is higher than a pressure which is used in the air suspensions to the air tank.

Further, since the first and second pistons 11, 14 are configured as the oscillating pistons to which the first and second connecting rods 12, 15 are connected integrally, the number of parts involved can be reduced, whereby it is possible to realize an improvement in assembling efficiency and a reduction in fabrication cost.

Figure 5:
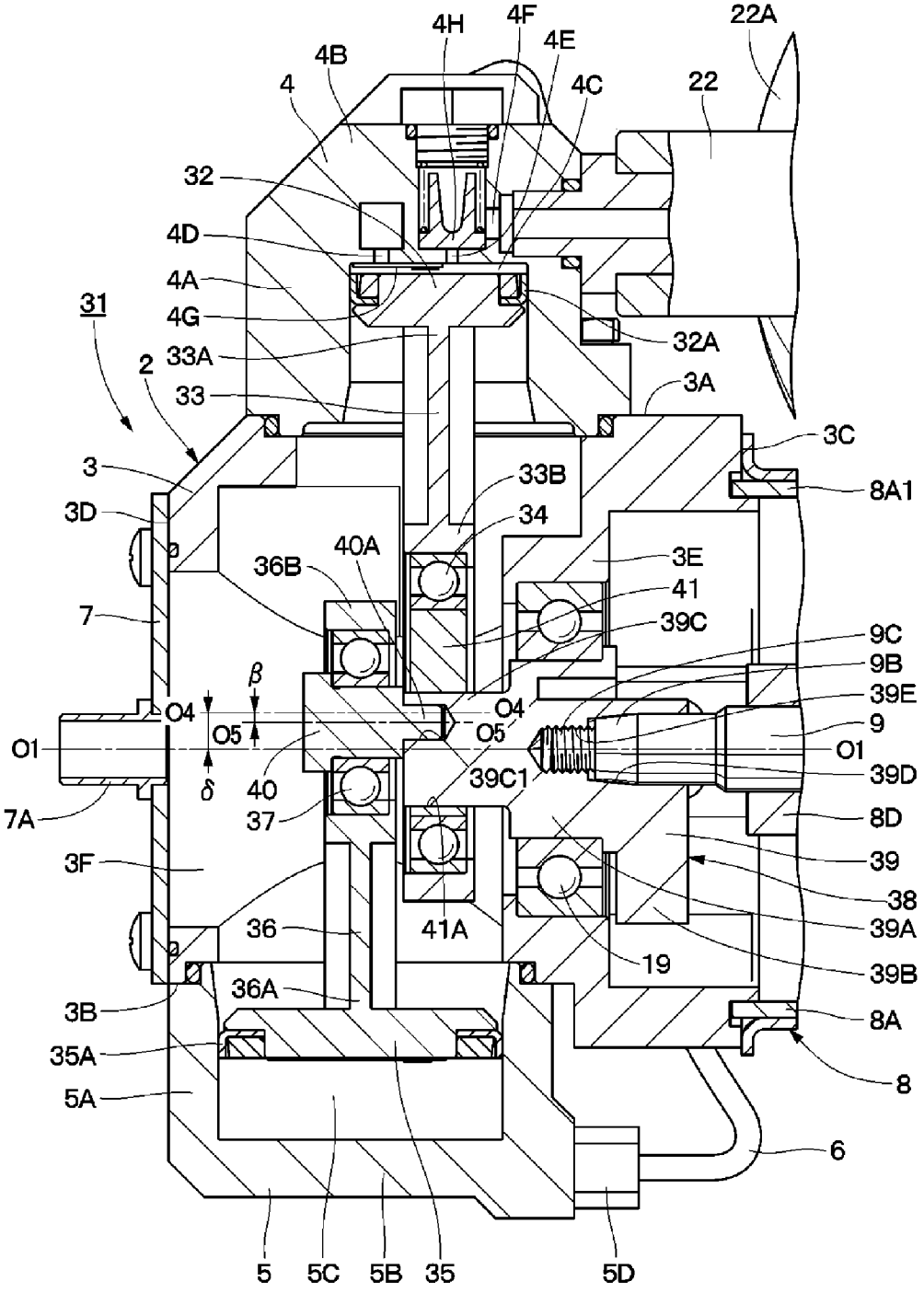

Next, FIG. 5 shows a second embodiment of the invention. The second embodiment is characterized in that the crank member of the first embodiment is formed into a rotating member which is coaxial with a drive shaft, in that an eccentric member which is similar to a conventional one is provided for connection with a first bearing of a first connecting rod, and in that a shaft portion which is fittingly inserted in a second bearing of a second connecting rod is mounted by a positioning member. It is noted that in the second embodiment, like reference numerals will be given to like constituent elements to those of the first embodiment described above, and the description thereof will be omitted here.

In FIG. 5, almost similar to the reciprocating air compressor 1 of the first embodiment described above, a reciprocating air compressor 31 of the second embodiment includes a casing 2, an electric motor 8 and an air drier 22, which are similar to those of the first embodiment, as well as first and second pistons 32, 35, first and second connecting rods 33, 36, a rotating member 38 and an eccentric member 41, which will all be described later.

Almost similar to the first piston 11 of the first embodiment described above, the first piston 32 of the second embodiment is made up of an oscillating piston (a rocking piston) which is fittingly inserted within a first cylinder 4 so as to reciprocate (slide) therein and functions to recompress air of intermediate pressure which is supplied from a second cylinder 5 which constitutes a low-pressure side cylinder in a compression chamber 4C of the first cylinder 4. The first piston 32 is made up of a circular disc member, and a lip seal 32A is mounted on a circumference of the first piston 32. When a side of the first piston 32 which is opposite to a cylinder head 4B is referred to as a front surface, one end 33A of the first connecting rod 33, which will be described later, is attached integrally to a central portion of an opposite or back surface of the first piston 32.

Almost similar to the first connecting rod 12 of the first embodiment described above, the first connecting rod 33 of the second embodiment is attached integrally to the central portion of the back surface of the first piston 32 at the longitudinal end 33A thereof. On the other hand, the other longitudinal end of the connecting rod 33 is situated within a crank chamber 3F of a crankcase 3 and constitutes a cylindrical bearing supporting portion 33B. A first bearing 34 is fittingly inserted into the bearing supporting portion 33B in such a way as not to be dislocated therefrom. However, the first connecting rod 33 of the second embodiment differs from the first connecting rod 12 of the first embodiment in that a first bearing 34 is expanded in diameter since the eccentric member 41, which will be described later, is mounted at a radially inner side of the first connecting rod 33 and in that the bearing supporting portion 33B is expanded in diameter in association with to the diametrical increase of the first bearing 34.

Almost similar to the second piston 14 of the first embodiment described above, the second piston 35 of the second embodiment is made up of an oscillating piston (a rocking piston) which is fittingly inserted within a second cylinder 5 so as to reciprocate (slide) therein and functions to compress outside air (atmosphere) which is taken in from the outside. The second piston 35 is made up of a circular disc member, and a lip seal 35A is mounted on a circumference of the second piston 35. Additionally, one end 36A of the second connecting rod 36, which will be described later, is attached integrally to a central portion of a back surface of the second piston 35.

Almost similar to the second connecting rod 15 of the first embodiment, the second connecting rod 36 of the second embodiment is attached integrally to a central portion of a back surface of the second piston 35 at a longitudinal end 36A thereof. On the other hand, the other longitudinal end of the connecting rod 36 is situated within the crank chamber 3F of the crankcase 3 and constitutes a cylindrical bearing supporting portion 36B. A second bearing 37 is fittingly inserted into the bearing supporting portion 36B in such a way as not to be dislocated therefrom. Thus, in the second connecting rod 36 of the second embodiment, as with the first connecting rod 33, the second bearing 37 is fittingly inserted therein in such a way as not to be dislocated therefrom.

Almost similar to the crank member 17 of the first embodiment, the rotating member 38 is positioned at the other end 9B side of a drive shaft 9, that is, within the crank chamber 3F of the crankcase 3 and is provided as a separate member from the drive shaft 9. This rotating member 38 is fittingly inserted into the first bearing 34 of the first connecting rod 33. Further, the rotating member 38 includes a positioning member 40 which positions the second bearing 37 with respect to an axial direction. To be specific, the rotating member 38 according to the second embodiment is made up of a rotating member main body 39 which makes up the rotating shaft of the invention and the positioning member 40 which makes up the connecting member of the invention.

Almost similar to the crank main body 18 of the first embodiment, the rotating member main body 39 which makes up the rotating member 38 includes a rotating shaft portion 39A, a weight portion 39B and a connecting shaft portion 39C. The rotating member main body 39 rotates coaxially with the drive shaft 9 of the electric motor 8, that is, about an axis O1-O1 as a center line thereof, and the connecting shaft portion 39C also rotates coaxially with the axis O1-O1, which is different from the first embodiment. This rotating member main body 39 constitutes the rotating shaft of the invention, and the connecting shaft portion 39C constitutes a first shaft portion of the invention.

A positioning member side hole 39C1 is formed in the connecting shaft portion 39C so as to be opened to the other end face thereof. On the other hand, a rotating shaft side internal thread portion 39E is provided in a deep portion of a positioning hole 39D which is opened at one end side thereof so as to be aligned with an axis of the rotating shaft portion 39A (the axis O1-O1). The other end 9B of the drive shaft 9 is fittingly inserted into this positioning hole 39D in a coaxial fashion, and an external thread portion 9C of the drive shaft 9 is screwed into the rotating shaft side internal thread hole 39E.

The positioning member 40, which functions as a connecting member in the second embodiment, makes up the rotating member 38 together with the rotating member main body 39. This positioning member 40 functions to position the second bearing 37 with respect to the axial direction. A cylindrical pin 40A at a distal end of the positioning member 40 is press fitted in a positioning member side hole 39C1 in the connecting shaft portion 39C.

The eccentric member 41 which is provided between the connecting shaft portion 39C and the first bearing 34 is formed as a thick annular member. This eccentric member 41 functions to position the first bearing 34 and the bearing supporting portion 33B of the first connecting rod 33 with respect to a radial direction so that an axis O4-O4 which is different from the axis O1-O1 of the connecting shaft portion 39C constitutes a center line for the first bearing 34 and the bearing supporting portion 33B. Additionally, a connecting hole 41A is provided in the eccentric member 41 so as to be coaxial with the axis O1-O1, and the connecting shaft portion 39C is press fitted in this connecting hole 41A. By doing so, the first piston 32 reciprocates in a stroke amount of 2δ via the first connecting rod 33.

The positioning member 40 is disposed so that a center line (an axis O5-O5) thereof deviates by a deviation amount β from a center line (an axis O4-O4) of the eccentric member 41. By adopting this configuration, a deviation amount of the positioning member 40 with respect to the axis O1-O1 of the rotating shaft portion 39A becomes the deviation amount δ−the deviation amount β(δ−β). Thus, it follows from this that the second piston 35 reciprocates in a stroke amount 2(δ−β) via the second connecting rod 36.

The two-stage reciprocating air compressor 31 according to the second embodiment is configured as has been described heretofore, and an example of an assembling procedure of this reciprocating air compressor 31 will be described below.

The rotating shaft portion 39A of the rotating member main body 39 is fittingly inserted in the crank bearing 19 which is mounted in the bearing supporting portion 3E of the crankcase 3. On the other hand, the first bearing 34 and the eccentric member 41 are sequentially assembled to the bearing supporting portion 33B of the first connecting rod 33. Similarly, the second bearing 37 is assembled to the bearing supporting portion 36E of the second connecting rod 36. The eccentric member 41 which is provided in the first connecting rod 33 is press fitted in the connecting shaft portion 39C of the rotating member main body 39 to thereby be positioned with respect to the axial direction.

Next, the pin 40A of the positioning member 40 is press fitted in the positioning member side hole 39C1 in the connecting shaft portion 39C. By doing so, the second bearing 37 can be positioned with respect to the axial direction. Additionally, the rotating member 38, the first and second connecting rods 33, 36 (the first and second pistons 32, 35) can be assembled to the crankcase 3.

When the rotating member 38 and the first and second connecting rods 33, 36 are assembled to the crankcase 3, the first cylinder 4, the second cylinder 5, a lid member 7, the electric motor 8 and the air drier 22 are mounted in the crankcase 3, whereby the reciprocating air compressor 31 can be built up.

Thus, according to the second embodiment that is configured as has been described heretofore, almost similar to the first embodiment described before, it is possible to realize a reduction in size and fabrication cost of the electric motor 8 which is provided integrally with the drive shaft 9. Moreover, in the second embodiment, the eccentric member 41 is used to make the first connecting rod 33 eccentric, and the eccentric member 41 is made up only of the thick annular member and the connecting hole 41A which is formed therein. Consequently, the configuration can be simplified, and moreover, the compression ratio can easily be controlled by replacing the eccentric member 41 with other eccentric members 41 with connecting holes 41A whose deviation amounts vary.

It is noted that in the first embodiment, both the first piston 11 and the second piston 14 are formed as the oscillating pistons (the rocking pistons). However, the invention is not limited thereto, and hence, for example, a configuration may be adopted in which either or both of the first piston 11 and the second piston 14 are connected to the corresponding connecting rods via connecting pins. This configuration can also equally be applied to the second embodiment.

In addition, in the first embodiment, the first cylinder 4, the first piston 11, the first connecting rod 12 and the first bearing 13, which constitute the high-pressure side, are described as being disposed on the one side (the electric motor 8 side), while the second cylinder 5, the second piston 14, the second connecting rod 15 and the second bearing 16, which constitute the low-pressure side, are described as being disposed on the other side (the lid member 7 side). However, the invention is not limited thereto, and hence, for example, a configuration may be adopted in which the members on the high-pressure side are disposed on the other side, while the members of the low-pressure side are disposed on the one side. This configuration can also equally be applied to the second embodiment.

Further, in the first embodiment, the first cylinder 4 and the second cylinder 5 on the casing 2 are described as being disposed so as to hold the crank chamber 3F of the crankcase 3 therebetween. However, the invention is not limited thereto, and hence, for example, a configuration may be adopted in which the first cylinder and the second cylinder are disposed into a V-shape, as long as they still surround the crank chamber 3F. This configuration can also equally be applied to the second embodiment.

In the embodiments described above, while the electric motor 8 which is the driving device is described as being provided integrally with the reciprocating air compressor, the invention is not limited thereto. Hence, a configuration may be adopted in which an electric motor is provided as a separate member and the rotating shaft, that is, the crank member 17 or the rotating member main body 39 is rotated by means of a belt.

Additionally, in the first embodiment, while the axis O3-O3 of the internal thread hole 18C3 in the eccentric shaft portion 18C is described as being disposed to deviate by the deviation amount γ from the axis O2-O2 of the eccentric shaft portion 18C, no deviation may be defined between the two axes.

Further, in the first embodiment, while in addition to the second connecting rod 15, the first connecting rod 12 is also positioned with respect to the axial direction via the spacer 21, the invention is not limited thereto. Hence, a configuration may be adopted in which the first connecting rod 12 is positioned by being press fitted in the crank main body 18, whereas only the second connecting rod 15 is positioned by the positioning member 20.

Further, in the embodiments described above, while the two-stage reciprocating air compressor is adopted, in the event of a large amount of air being required, the first and second cylinders may be used parallel to each other.

Next, the inventions will be described which are understood to be incorporated in the embodiments. To be specific, the invention adopts the configuration in which the axis of the first shaft portion differs from the axis of the connecting member. By adopting this configuration, the stroke amounts of the first piston and the second piston are controlled to thereby match the compression ratio of the high-pressure side with the compression ratio of the low-pressure side. Moreover, since only the two members such as the first shaft portion and the connecting member are involved, the axis of the first shaft portion and the axis of the connecting member can be disposed to deviate from each other with the simple configuration.

According to the invention, the respective stroke amounts of the first and second pistons are made to differ by providing the eccentric member which makes the respective center lines of the first and second bearings differ from each other between the first shaft portion and the first bearing of the first connecting rod and/or between the connecting member and the second bearing of the second connecting rod. By adopting this configuration, the respective stroke amounts of the first and second pistons can be made to differ from each other with the simple configuration in which only the eccentric member is used. Additionally, the compression ratio can easily be controlled by replacing the eccentric member with other eccentric members having different deviation amounts.

On the other hand, according to the invention, the second cylinder is the low-pressure cylinder which takes in gas of low pressure to discharge compressed gas of intermediate pressure, whereas the first cylinder is the high-pressure cylinder which takes in the compressed gas of intermediate pressure to discharge compressed gas of high pressure. By adopting this configuration, the reciprocating compressor can compress gas in two stages and can supply the air tank with, for example, compressed air of higher pressure which is higher than the pressure of gas or air used in the air suspensions.

Further, according to the invention, the first and second pistons are both configured as the oscillating pistons. By adopting this configuration, the number of constituent parts can be reduced, thereby making it possible to realize not only an improvement in assembling properties but also a reduction in fabrication cost.

Although only some exemplary embodiments of this invention have been described in detail above, those skilled in the art will readily appreciate that many modifications are possible in the exemplary embodiments without materially departing from the novel teaching and advantages of this invention. Accordingly, all such modifications are intended to be included within the scope of this invention.

The present application claims priority under 35 U.S.C. section 119 to Japanese Patent Application No. 2013-074342, filed on Mar. 29, 2013. The entire disclosure of Japanese Patent Applications No. 2013-074342, filed on Mar. 29, 2013 including specification, claims, drawings and summary is incorporated herein by reference in its entirety.

What is claimed is:

1. A reciprocating compressor comprising:

a casing including a crank case, a first cylinder and a second cylinder, the first and second cylinders being disposed so as to surround a crank chamber of the crank case;

a rotating shaft which is mounted rotatably in the casing;

a driving device which is connected to one end side of the rotating shaft, wherein the rotating shaft rotates in response to rotation of the driving device;

first and second pistons which are fittingly inserted in the first and second cylinders, respectively, so as to reciprocate therein;

a first connecting rod having an end portion attached to the first piston, and an opposite end portion situated in the crank chamber where a first bearing is provided;

a second connecting rod having an end portion attached to the second piston, and an opposite end situated in the crank chamber where a second bearing is provided;

a first shaft portion which is inserted into the first bearing and is provided at the other end side of the rotating shaft;

a connecting member which is fittingly inserted into the second bearing and is provided at a distal end portion of the first shaft portion, wherein:

the connecting member includes a cylindrical shaft portion which is inserted into the second bearing for direct support of the second bearing and a fixing portion which protrudes from an end of the cylindrical shaft portion and is fixed to the first shaft portion;

the connecting member positions the second bearing at the first shaft portion in the axial direction of the connecting member; and the axis of the first bearing and the axis of the second bearing deviate from the axis of the rotating shaft.

2. The reciprocating compressor according to claim 1, wherein an axis of the first shaft portion and an axis of the connecting member are made to differ from each other.

3. The reciprocating compressor according to claim 1, wherein an eccentric member is provided between the first shaft portion and the first bearing, the eccentric member being formed as an annular member and having an axis deviating from the axis of the first shaft portion, the first bearing being received on the eccentric member.

4. The reciprocating compressor according to claim 2, wherein an eccentric member is provided between the first shaft portion and the first bearing, the eccentric member being formed as an annular member having an axis deviating from the axis of the first shaft portion, the first bearing being received on the eccentric member.

5. The reciprocating compressor according to claim 1, wherein the second cylinder is a low-pressure cylinder which takes in gas of low pressure to discharge compressed gas of intermediate pressure, and the first cylinder is a high-pressure cylinder which takes in the gas of intermediate pressure to discharge compressed gas of high pressure.

6. The reciprocating compressor according to claim 2, wherein the second cylinder is a low-pressure cylinder which takes in gas of low pressure to discharge compressed gas of intermediate pressure, and the first cylinder is a high-pressure cylinder which takes in the gas of intermediate pressure to discharge compressed gas of high pressure.

7. The reciprocating compressor according to claim 3, wherein the second cylinder is a low-pressure cylinder which takes in gas of low pressure to discharge compressed gas of intermediate pressure, and the first cylinder is a high-pressure cylinder which takes in the gas of intermediate pressure to discharge compressed gas of high pressure.

8. The reciprocating compressor according to claim 1, wherein both the first piston and the second piston are configured as an oscillating piston.

9. The reciprocating compressor according to claim 2, wherein both the first piston and the second piston are configured as an oscillating piston.

10. The reciprocating compressor according to claim 3, wherein both the first piston and the second piston are configured as an oscillating piston.

11. The reciprocating compressor according to claim 1, wherein the axis of the second bearing is coaxial to the axis of the connecting member.

12. The reciprocating compressor according to claim 1, wherein the axis of the first shaft portion deviates from the axis of the rotating shaft.

13. The reciprocating compressor according to claim 1, wherein the axis of the first shaft portion is coaxial to the axis of the rotating shaft.

14. The reciprocating compressor according to claim 13, wherein an eccentric member is provided between the first shaft portion and the first bearing, the eccentric member being formed as an annular member and having an axis deviating from the axis of the first shaft portion.

15. The reciprocating compressor according to claim 3, wherein the axis of the eccentric member and the axis of the connecting member are made to differ from each other.

16. The reciprocating compressor according to claim 14, wherein the axis of the eccentric member and the axis of the connecting member are made to differ from each other.

17. The reciprocating compressor according to claim 1, wherein the connecting member includes an external thread portion which is formed as the fixing portion, and a head portion which is formed by expanding diametrically the other end of the cylindrical shaft portion.

18. The reciprocating compressor according to claim 1, wherein the connecting member includes a pin which is formed as the fixing portion, and a head portion which is formed by expanding diametrically the other end of the cylindrical shaft portion.

* * * * *